US006811870B2

(12) United States Patent
Zafiroglu

(10) Patent No.: US 6,811,870 B2
(45) Date of Patent: Nov. 2, 2004

(54) METHOD FOR FORMING CHENILLE YARNS AND THE CHENILLE YARNS PRODUCED THEREBY

(76) Inventor: Dimitri Zafiroglu, 303 Pentland Dr., Wilmington, DE (US) 19807

( * ) Notice: Subject to any disclaimer, the term of this patent is extended or adjusted under 35 U.S.C. 154(b) by 227 days.

(21) Appl. No.: 10/271,369

(22) Filed: Oct. 15, 2002

(65) Prior Publication Data

US 2004/0069402 A1 Apr. 15, 2004

(51) Int. Cl.[7] ..... D02G 3/00; D02G 3/42; D03D 27/18

(52) U.S. Cl. ..... 428/357; 428/92; 57/203; 57/207; 57/24; 28/220; 28/144; 156/166

(58) Field of Search ..... 428/92, 357; 442/304; 57/24, 203, 207; 28/220, 144; 156/166

(56) References Cited

U.S. PATENT DOCUMENTS

| | | | |
|---|---|---|---|
| 3,009,235 | A | 11/1961 | Mestral |
| 3,168,883 | A | 2/1965 | Ploch et al. |
| 3,715,878 | A | 2/1973 | Kim |
| 3,837,943 | A | 9/1974 | Ploch et al. |
| 5,470,629 | A | 11/1995 | Mokhtar et al. |
| 5,472,762 | A | 12/1995 | Edwards et al. |
| 5,496,508 | A | 3/1996 | Hettinga et al. |
| 5,498,459 | A | 3/1996 | Mokhtar et al. |
| 5,651,168 | A | 7/1997 | Tung et al. |
| 5,906,877 | A | 5/1999 | Popper et al. |

FOREIGN PATENT DOCUMENTS

| | | |
|---|---|---|
| JP | 4-352840 | 12/1992 |

*Primary Examiner*—N. Edwards

(57) ABSTRACT

A warp knit fabric having a plurality of stitches formed by overlaps arranged in adjacent, longitudinally extending wales with transverse underlaps connecting the overlaps of adjacent wales and with a binder material extending along the wales is used to produce a chenille yarn having a core and a pile. The pile of the chenille yarn is defined by the slit transverse underlaps and the core is defined by the overlaps of the stitches and the binder. Either before or after slitting, either the fabric or the chenille yarns is(are) heated to activate the binder. A tensile force is imposed either during or after heating.

19 Claims, 13 Drawing Sheets

METHOD FOR FORMING CHENILLE YARNS AND THE CHENILLE YARNS PRODUCED THEREBY

BACKGROUND OF THE INVENTION

1. Field of the Invention

This invention relates to a method for forming chenille yarns and the chenille yarns produced thereby.

2. Description of the Prior Art

Chenille yarn is a specialty yarn typically used in upholstery and decorative fringe applications. A chenille yarn includes a central portion, or core, from which short pile strands protrude.

Chenille yarn is typically formed on a yarn manufacturing device that co-twists two or more continuous yarns to form a core. Twisting the core yarns provides strength to the resulting chenille yarn. The pile, which is formed of discontinuous fibers, is gripped between and protrudes transversely from around the core yarns.

U.S. Pat. No. 5,496,508 (Tung et al.) is exemplary of the typical process for the formation of a high-bulk chenille yarn. A binding thread is formed by air texturing a polyethylene yarn with a binder yarn. A chenille yarn is formed by twisting together a pair of the binding threads so as to engage sheared lengths of pile yarn therebetween. During finishing the polyethylene component of the chenille yarns is melted to bond the pile yarns to the binding threads.

Chenille yarns may also be formed by slitting the fill threads of a woven fabric intermediate the longitudinally extending warp threads of the fabric to form narrow ribbons. Thereafter, two or more of the resulting ribbons are twisted together.

U.S. Pat. No. 3,715,878 (Kim) discloses a process for making chenille yarn in which longitudinal warp threads are provided both above and below web of fill threads. The warp threads are bonded to the fill threads and slit between the warp threads to form the chenille yarn.

U.S. Pat. No. 5,498,459 (Mokhtar et al.) discloses a tuft-string structure having pile yarn bundles bonded to a central support strand. The pile yarn bundles extend in only one direction from the central support strand such that, when attached to a backing, a pile surface structure (carpet) is formed.

Japan Published Application 4-352,840 discloses a process for forming a chenille yarn from a knit fabric. A plurality of foundation yarns is formed. Each foundation yarn has a longitudinally extending core thread formed as a chain stitch. Transversely extending filaments link together adjacent foundation yarns. The transversely extending filaments are cut, forming the chenille yarn. The use of a heat-activated binder material is avoided as this is seen to cause the chenille yarn to have a stiff feel. The product relies on the tightness of the chain stitch to prevent pile pull-out and therefore, durability is limited.

The process disclosed in U.S. Pat. Nos. 3,168,883 and 3,837,943 (both to Ploch et al.) uses composite binder stitching threads and shrinkable yarns to post-tighten chain stitch loops and form durable velours or stitchbonded fabrics using a backing. The backing is not an adhesive layer that can be used as the binder in a chenille.

In view of the foregoing it is believed advantageous to provide a low cost process for forming chenille yarn that both very durable, and at the same time, soft, flexible and, preferably, stretchable. Multiple color capability, multiple fiber capability in pile and long pile is also believed desirable.

SUMMARY OF THE INVENTION

The present invention is directed to a method of producing a chenille yarn by forming a warp knit fabric in which a web of transversely extending underlaps connects adjacent overlaps of longitudinally extending stitches. The stitch overlaps are arranged in adjacent longitudinally extending wales. A binder material extends with the overlaps along the wales.

The binder material may be introduced into the knit fabric in a variety of ways. A strand of binder may be laid into the stitches or may be inserted transversely into the stitches. Alternatively, the binder may be provided in sheet form with the stitches penetrating into the sheet. Binder can also be introduced using a composite low melting temperature/high melting temperature thread as the stitching thread.

The transversely extending underlaps are slit between adjacent wales thereby to define a plurality of precursor chenille yarns, each precursor chenille yarn including a wale of stitch overlaps and binder surrounded by an array of slit transverse underlaps. Either before or after slitting either the knit fabric or the precursor chenille yarns (as the case may be) is(are) heated to activate the binder. The binder material has a tendency to contract under heating into a continuous, longitudinally extending, elongate, irregular-shaped stripe, thus causing the fabric or the precursor chenille yarn to shrink or to contract longitudinally. Accordingly, in accordance with this invention, either during or after heating a tensile force is applied to the fabric or the yarn. The tensile force either prevents the formation of such a continuous stripe of binder chain within the core or breaks the continuity of the stripe of binder into discrete beads of binder material, thereby to form a finished chenille yarn. The core of the finished chenille yarn is defined by the overlaps of the stitches and the pile of the finished chenille yarn is defined by the slit transverse underlaps, with the pile of the finished chenille yarn being held to the core by one or more discrete bead(s) of binder.

The method of the present invention is believed to provide an efficient way to make chenille yarn in which the pile yarn is secured to the core by the beads of binder material. The tendency of the binder to form continuous, longitudinally extending, elongate, irregular-shaped stripe is countered by the application of the tensile force either during or after heating, as the case may be.

BRIEF DESCRIPTION OF THE DRAWINGS

The invention will be more fully understood from the following detailed description thereof, taken in connection with the accompanying drawings, which form a part of this application and in which:

FIGS. 2A through 2F are diagrammatic views of the chenille yarn product produced at various stages through the system of FIG. 1, wherein:

FIG. 2A is stylized generalized illustration of a knit fabric produced at the output of a knitting apparatus;

FIG. 2B are stylized illustrations of the precursor chenille yarn formed by the slitter;

FIG. 2C is a stylized illustration of the precursor chenille yarn after heating without the imposition of a tensile force;

FIG. 2D is a stylized illustration of the finished chenille yarn;

FIG. 2E is a stylized illustration of the knit fabric before slitting but after heating in the absence of a tensile force;

FIG. 2F is a stylized illustration of the knit fabric before slitting but after heating in the presence of a tensile force;

DETAILED DESCRIPTION OF THE INVENTION

Figure 1:
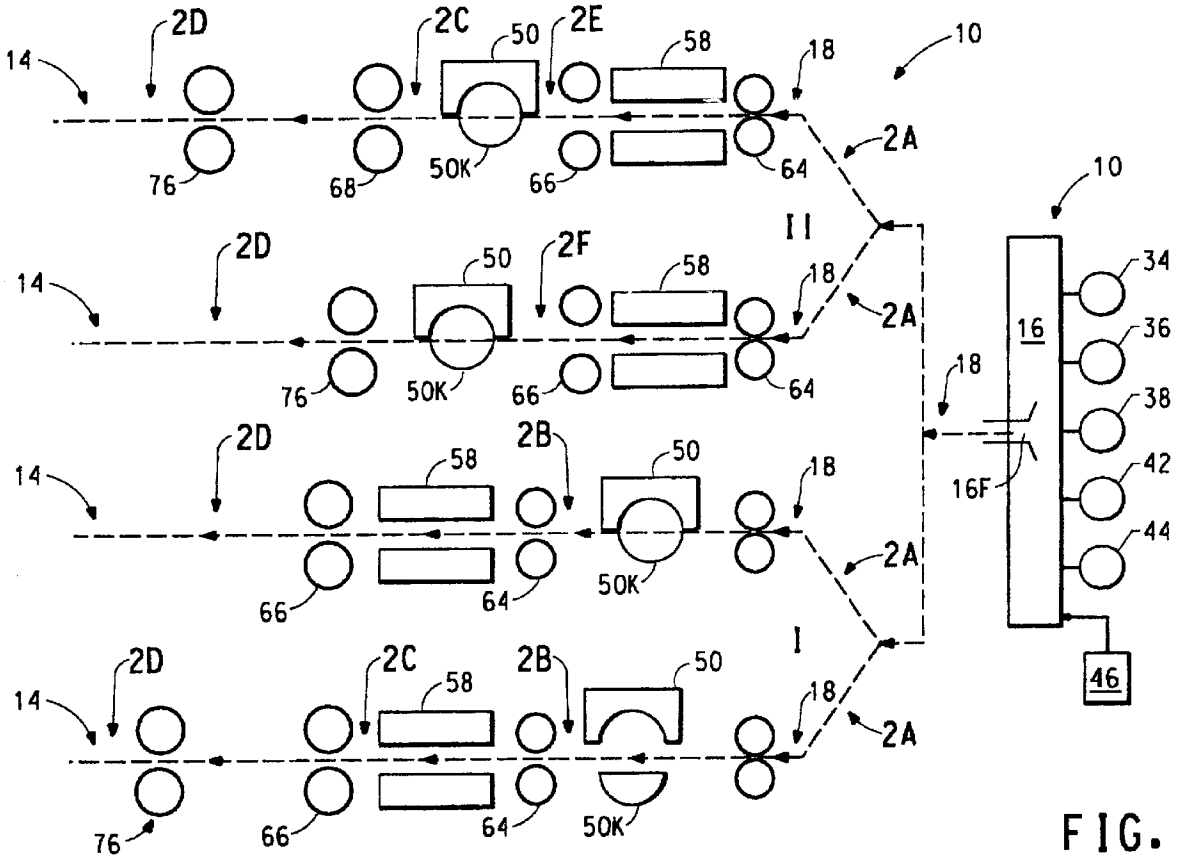
FIG. 1 is a highly stylized pictorial representation illustrating alternate embodiments of a system useful for forming chenille yarn in accordance with various aspects of the present invention, with annotations to the appropriate drawing of the structure as shown in FIG. 2 being indicated in boxes at the corresponding positions in FIG. 1.

Throughout the following detailed description similar reference numerals refer to similar elements in all figures of the drawings.

FIG. 1 is a highly stylized pictorial representation of alternate embodiments of a system generally indicated by the reference character 10 useful for forming a finished chenille yarn in accordance with various aspects of the present invention. The finished chenille yarn is generally indicated by the reference character 14.

The system 10 includes a warp knitting apparatus 16 for forming a warp knit fabric 18. Suitable for use as the knitting apparatus 16 is that apparatus manufactured by Karl Mayer Textilmaschinenfabrik GmbH, Obertshausen, Germany and sold as model RS-3. The apparatus 16 may include an array of forwardly extending sinker fingers 16F, if desired.

Figure 2A:
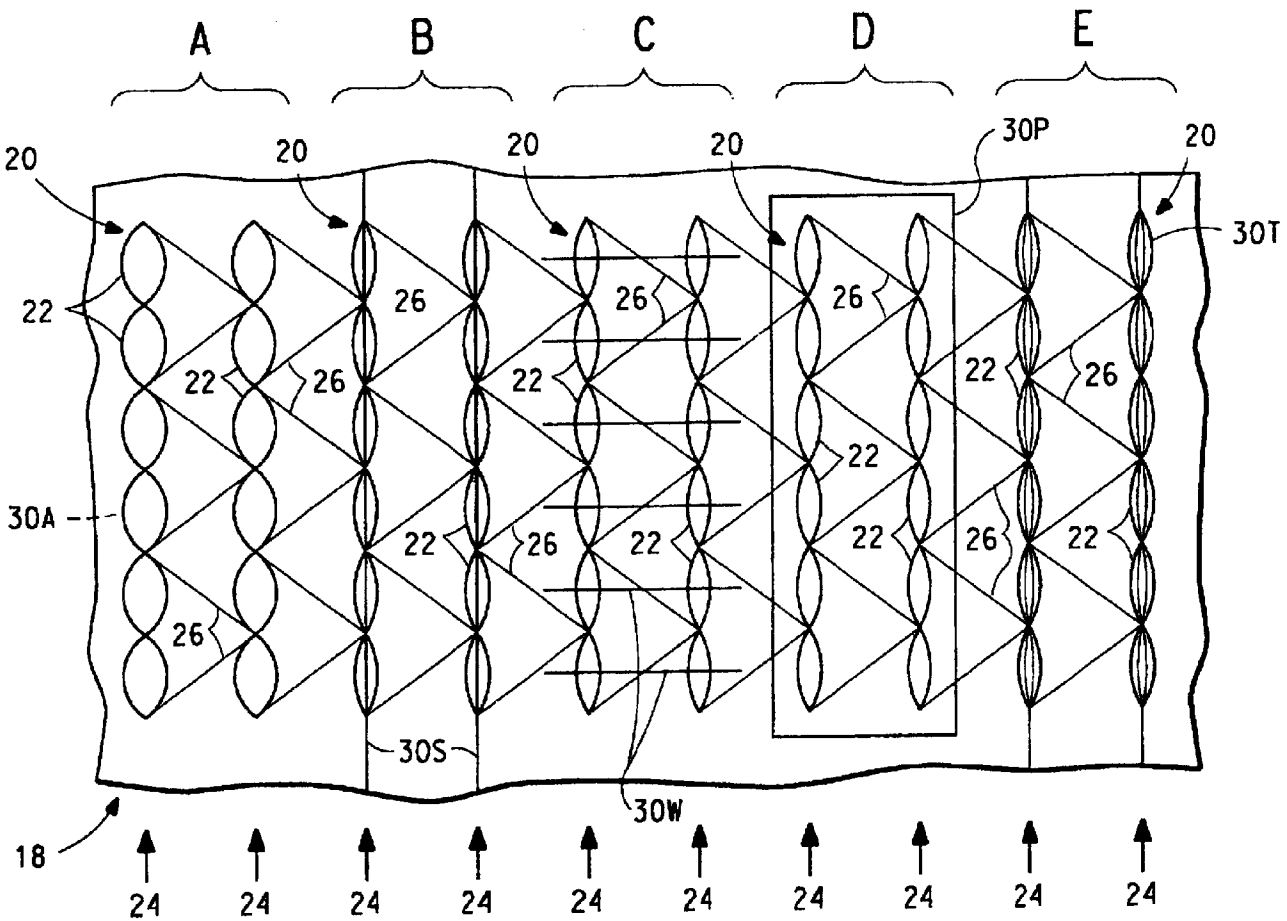

FIG. 2A is a stylized generalized schematic illustration of a knit fabric 18 produced at the output of the knitting apparatus 16. More detailed views of the structure of the various forms of the knit fabric 18 produced in accordance with the present invention are shown in FIGS. 3A through 3E and FIGS. 4A through 4E.

Generally speaking, with reference to FIG. 2A, the knit fabric 18 comprises a plurality of stitches generally indicated by the reference character 20 (depicted in FIG. 2A as oval structures believed most clearly visible in region "A" of the drawing). The stitches 20 include overlap portions ("overlaps") 22 that are arranged in adjacent, longitudinally extending wales 24. Transverse underlap portions ("underlaps") 26 connect the overlaps 22 of the stitches 20 between adjacent wales 24. As will be shown more fully herein the stitches 20 may be formed such that the underlaps 26 may be either laid-in or knitted into the fabric 18. The use of sinker fingers 16F in the knitting apparatus 16 increases the length of the underlaps 26 resulting in longer pile length in the finished chenille yarn 14.

In accordance with the present invention the fabric 18 includes an adhesive binder material generally indicated by reference character 30 that extends along the wales 24. The binder material 30 may be introduced into the fabric 18 in a variety of ways as will be more fully developed herein. For example, the binder may be included as a binder component 30C within the stitching thread used to form the stitches 20 (as suggested by the dashed leader line in region "A" of the drawing) (see also, FIGS. 3A, 4A where the binder component 30C is indicated by the stipled hatching). Alternatively, the binder material may be introduced in the wales 24 in the form of a laid-in longitudinal strand 30S (as depicted in region "B" of the drawing) or as a weft-extending strand 30W (as depicted in region "C" of the drawing). The binder material 30 may be alternatively introduced in the form of a planar sheet 30P (as depicted in region "D" of the drawing) or in the form of an additional chain stitching thread 30T that loops with the thread forming the basic stitch. This expedient is depicted in region "E" of the drawing.

As the term is used herein "binder" refers to a thermoplastic polymeric adhesive material that melts at a lower temperature than the rest of the materials in the structure. As will be developed herein the binder material serves to attach the underlaps 26 to the overlaps 22 of the stitches 20, thereby to hold the underlaps 26 in place. The polymer used to form the binder material must melt at a temperature about ten to fifty degrees Centigrade (10–50° C.) less than the lowest melting temperature of the other materials used in the knit structure 18. Suitable for use as the binder material are strands or sheets of polypropylene, polyethyelene, polyvinyl acetate, or low-melting copolymers of polyesters or polyamides. Any of these materials can be used with a higher melting point material to form composite stitching thread in which the binder is introduced as a component 30C of the thread.

Reverting to FIG. 1 the system 10 includes one or more yarn beams 34, 36 and 38 which supply the yarn(s) needed to form the overlaps 22 and transverse underlaps 26 of the stitches 20 being produced. If plural yarns are used to form the stitches, the yarns may be of different color and/or textures. An additional supply beam 42 may be used for supplying a binder strand 30S (FIG. 2A) to the knit fabric, if desired. Alternatively or additionally, a supply roll 44 may be provided if it is desired to supply binder material in the form of a sheet 30P (FIG. 2A). As a further alternative or addition a weft insertion mechanism 46 for introducing a binder strand 30W (FIG. 2A) in the weft direction may also be associated with the apparatus 16. If needed, additional beams beyond those already suggested may be used to supply the thread 30T.

Figure 2B:
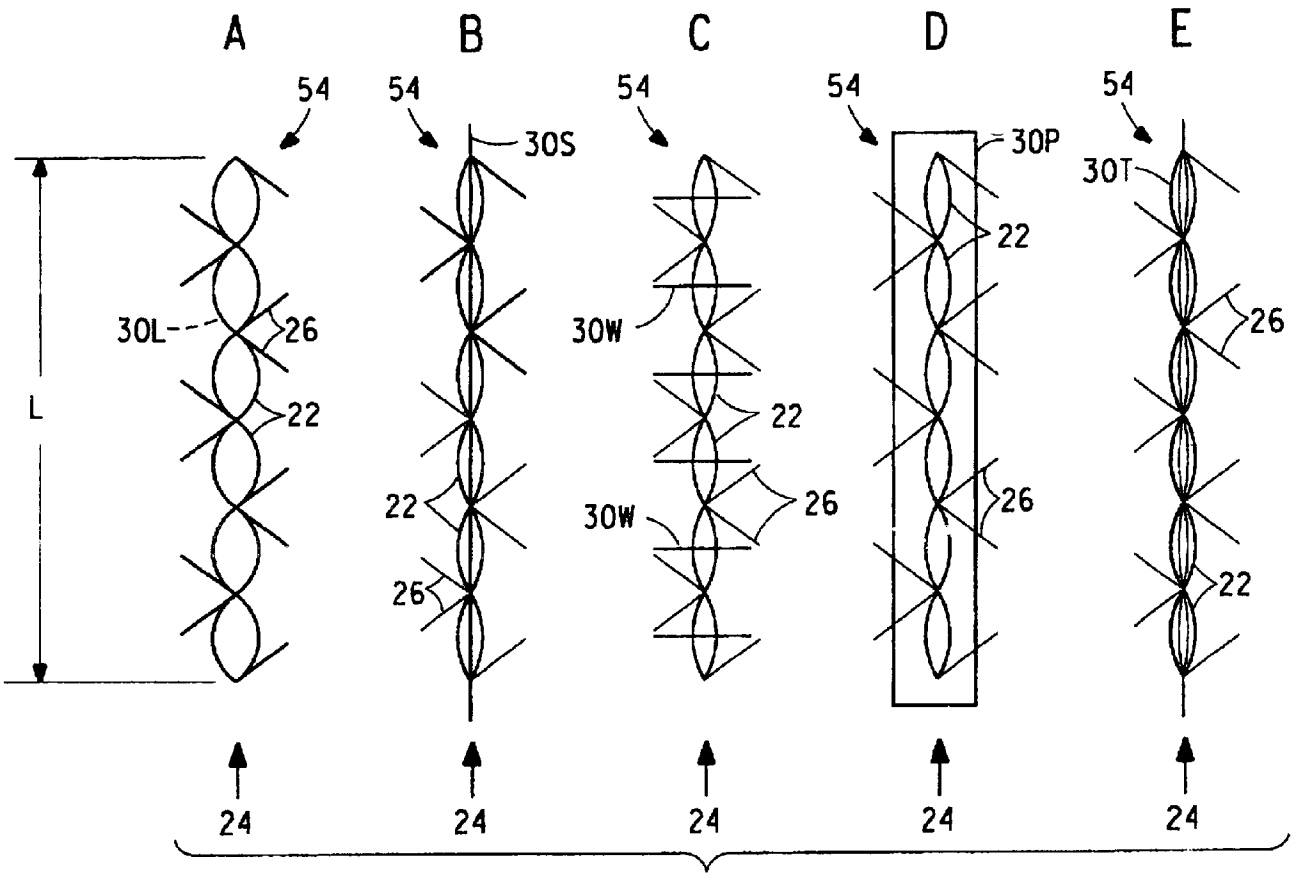
Figure 5A:
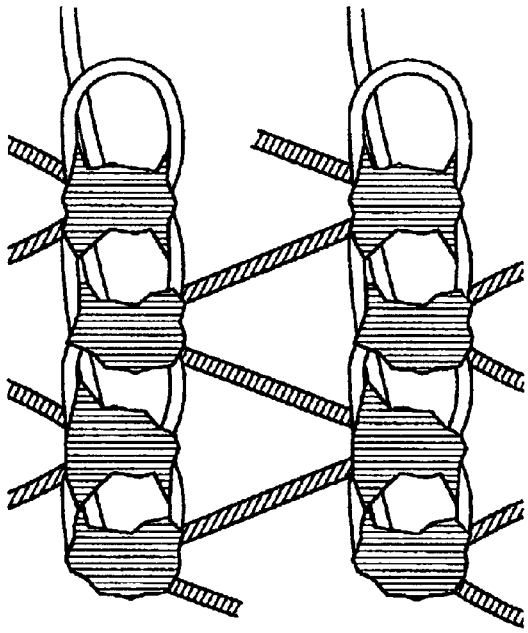
FIGS. 5A and 5B are enlarged views of the structure of the finished chenille yarn produced from a knit fabric having laid-in underlaps and stitched-in underlaps, respectively.
Figure 5B:
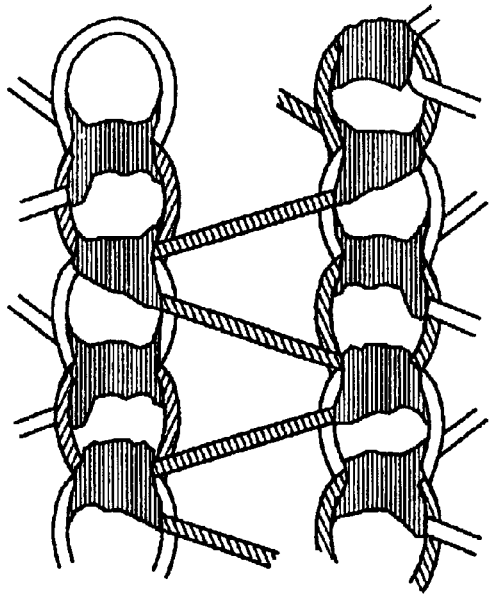

In accordance with the present invention the fabric is slit between adjacent wales to define a plurality of precursor chenille yarns 54 (FIG. 2B). Each precursor chenille yarn 54 includes a wale of stitch overlaps and binder surrounded by an array of slit transverse underlaps. Either before or after slitting the fabric 18 or the precursor chenille yarns 54 slit therefrom is(are) heated to activate the binder. In addition, either during or after heating, a tensile force on the fabric 18 or the precursor chenille yarns 54 either to form a discontinuous chain of beads of binder within the core or to break the binder within the core into a discontinuous chain of beads of binder, respectively. As a result a finished chenille yarn is formed in which the core of the finished chenille yarn is defined by the overlaps of the stitches and the pile of the finished chenille yarn is defined by the slit transverse underlaps, the pile of the finished chenille yarn being held to the core by one or more bead(s) of binder (FIGS. 5A, 5B).

Slit Before Heat

In Implementation Path I of the system 10 of the present invention (shown along the lower half portion of FIG. 1) the knit fabric 18 is introduced to a slitting device 50 that is disposed immediately downstream of the warp knitting apparatus 16. The slitting device 50 includes a plurality of slitting knives 50K which serve to slit longitudinally the knit fabric 18 emerging from the knitting apparatus 12 and thereby form unfinished or precursor chenille yarns 54.

The fabric 18 is arranged so as to advance into the slitting device 50 with the wales 24 of the fabric 18 disposed between adjacent slitting knives 50K. The knives 50K slit the web of yarn underlaps 26 of the fabric 18 to define the chenille yarn precursors 54. Generally speaking, each chenille yarn precursor 54 includes a wale 24 of stitch overlaps 22 (with binder material 30 along the wale 24) and severed transverse underlaps 26.

FIG. 2B contains stylized illustrations of chenille yarn precursors 54 resulting from the slitting of a knit fabric 18 formed as illustrated in the various regions "A" through "E" of FIG. 2A. Slitting a fabric 18 in which the binder material 30C is a component of the stitching thread (as suggested in Region "A" of FIG. 2A) results in a precursor chenille yarn 54 as illustrated in Region "A" of FIG. 2B. Slitting a fabric 18 configured as in Region "B" of FIG. 2A results in a precursor chenille yarn 54 with a longitudinally extending strand 30S of binder material extending along the wale 24, as illustrated in Region "B" of FIG. 2B. Analogously, a fabric 18 having weft inserted binder strands 30W configured as in Region "C" of FIG. 2A results in a precursor chenille yarn 54 with a transverse strand 30W of binder material as illustrated in Region "C" of FIG. 2B. If the binder material is inserted into the fabric 18 in the form of a sheet 30P as shown in Region "D" of FIG. 2A, the sheet 30P is slit simultaneously with the slitting of the web yarns, resulting in a precursor chenille yarn 54 with a strip of binder material 30P extending along each separated wale 24, as illustrated in Region "D" of FIG. 2B. If binder is contained in the form of the additional stitching thread 30T as shown in Region "E" of FIG. 2A the thread 30T remains in the resulting precursor chenille yarn 54 shown in Region "E" of FIG. 2A. The representative length of the chenille yarn precursors 54 is indicated in FIG. 2B by the reference character L.

After slitting the precursor chenille yarns 54 are heated to activate the binder material. In accordance with the present invention a tensile force is imposed on the precursor chenille yarns 54 either during or after heating.

Figure 2C:
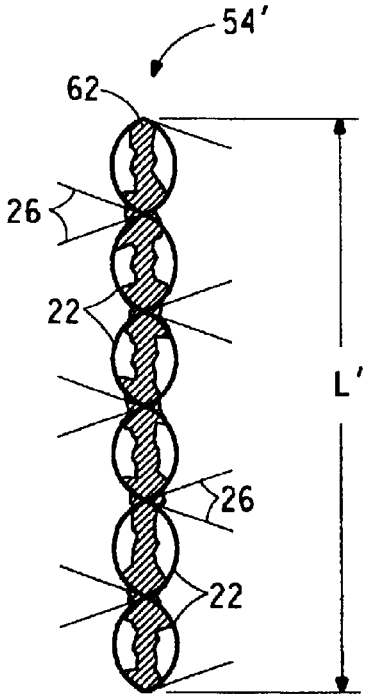

The lower branch of Implementation Path I shows the most preferred arrangement of the method of the present invention wherein the tensile force is applied after heating. The precursor yarns 54 are conveyed by pairs of drive rollers 64, 66 through a heating device 58. It is desirable for the rollers 66 to rotate at a surface speed that is slower (on the order of ten to thirty percent) than the surface speed of the rollers 64 thereby to allow the precursor yarn 54 (FIG. 2A) to contract and form the precursor yarn 54' (FIG. 2C). A precursor yarn 54 emanating from the heating device after the roll pair 64, 66 is illustrated in FIG. 2C.

Heating of the binder material 30 (however it may be initially introduced into the fabric 18) causes the binder to constrict and coalesce. Coalescence of the binder buckles the overlaps of the stitches in the chenille yarn precursor 54 (FIG. 2A) to form a continuous, longitudinally extending, elongate, irregular-shaped stripe 62 (FIG. 2C) of binder extending along the wale 24, thus longitudinally contracting the precursor yarn. The appearance of the stripe varies depending upon the form in which the binder is introduced (FIG. 2A, Regions A–E). The contracted precursor yarn 54' has a contracted length indicated in FIG. 2C by the reference character L'. The length L' is shorter than the representative length L indicated in FIG. 2B.

In this branch of implementation path I post-heating stretching is necessary to produce the finished chenille yarn 14. To this end another pair of drive rollers 76 is disposed downstream of the rollers 66. The drive rollers 76 operate at a surface speed greater than the speed of the rollers 66 thereby imposing a tensile force on the contracted precursor chenille yarns 54'. The tensile force stretches the contracted precursor yarn 54' (FIG. 2C), breaking the continuous irregular-shaped stripe 62 of binder into a discontinuous chain of beads 68 of binder (FIG. 2D).

Figure 2D:
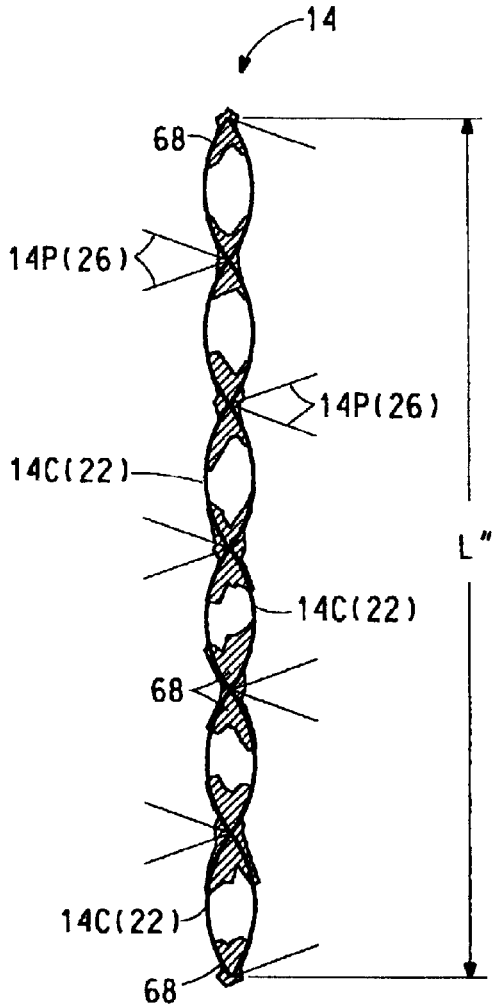

The finished chenille yarn 14 is shown in FIG. 2D. The core 14C of the finished chenille yarn 14 is derived from the overlaps 22 of the stitches 20 while the pile 14P of the finished chenille yarn is derived by the slit transverse underlaps 26. The pile 14P is held to the core by one or more bead(s) 68 of binder.

As mentioned, as an alternative the tensile force may be imposed upon the precursor yarn 54 (FIG. 2B) during heating. An arrangement to effect this alternative is shown in the upper branch of Implementation Path I. In this instance the drive rollers 66 that advance the precursor yarn 54 (FIG. 2B) through the heating device 58 are driven at a slightly higher surface speed than the rollers 64 (on the order of five to twenty percent greater). The precursor yarns are stretched while within the heating device 58. Imposing a tensile force while the yarns are being heated prevents the continuous irregular-shaped stripe 62 of binder (FIG. 2C) from being formed. Instead, the binder coalesces directly into the structure having the discontinuous beads 68 (FIG. 2D).

Heat Before Slit

An alternative arrangement is illustrated along Implementation Path II of the system 10 of the present invention (shown along the upper half of FIG. 1). In both branches of this Implementation Path II the fabric 18 produced by the apparatus 16 is heated in the heating apparatus 58 prior to slitting. As before discussed a tensile force may be imposed on the fabric either during, but more preferably, after heating.

Figure 2E:
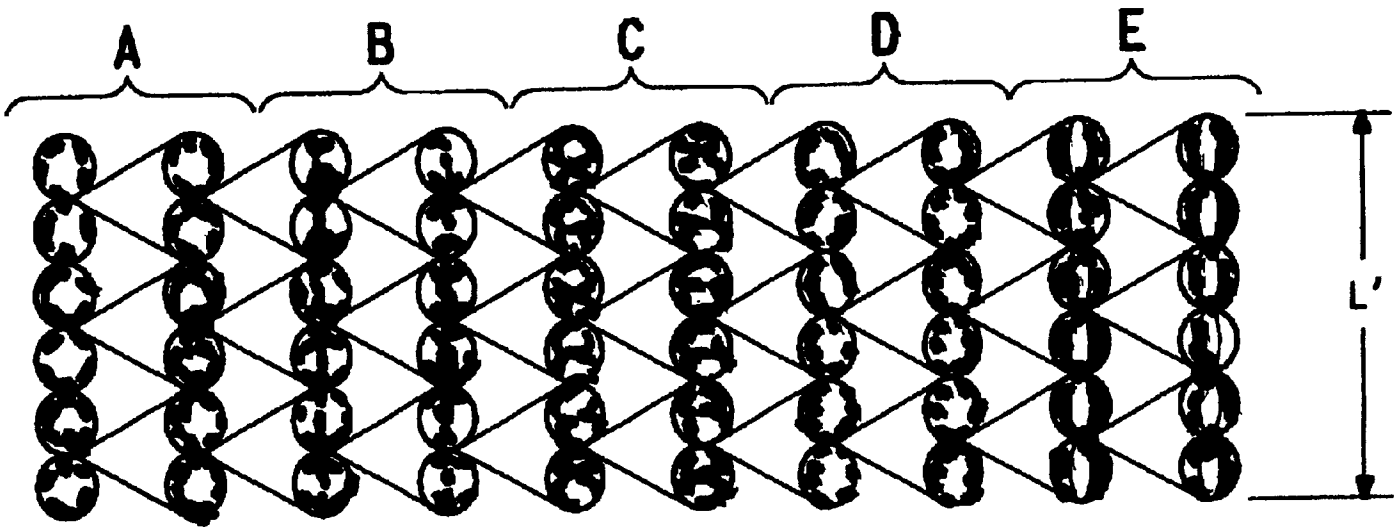

Along the upper branch of Implementation Path II the fabric 18 (FIG. 2A) is heated in the absence of a tensile force. This action produces the contracted fabric structure 18' shown in FIG. 2E. As seen in FIG. 2E the binder material (however introduced into the fabric 18) coalesces to produce continuous irregular-shaped stripes 62 of binder extending along the wales 24 of the fabric 18'. The contracted fabric 18' has a dimension D' that is less than the corresponding dimension D (FIG. 2A) of the fabric 18 prior to heating. The contracted fabric 18' is thereafter slit by the slitting device 50 to produce contracted precursor yarns 54' similar to those illustrated in FIG. 2C. The contracted precursor yarns 54' are stretched by the action of rolls 66, 76 having the appropriate surface speed surface speed to stretch the precursor yarns 54' to produce the finished chenille yarns 14.

Figure 2F:
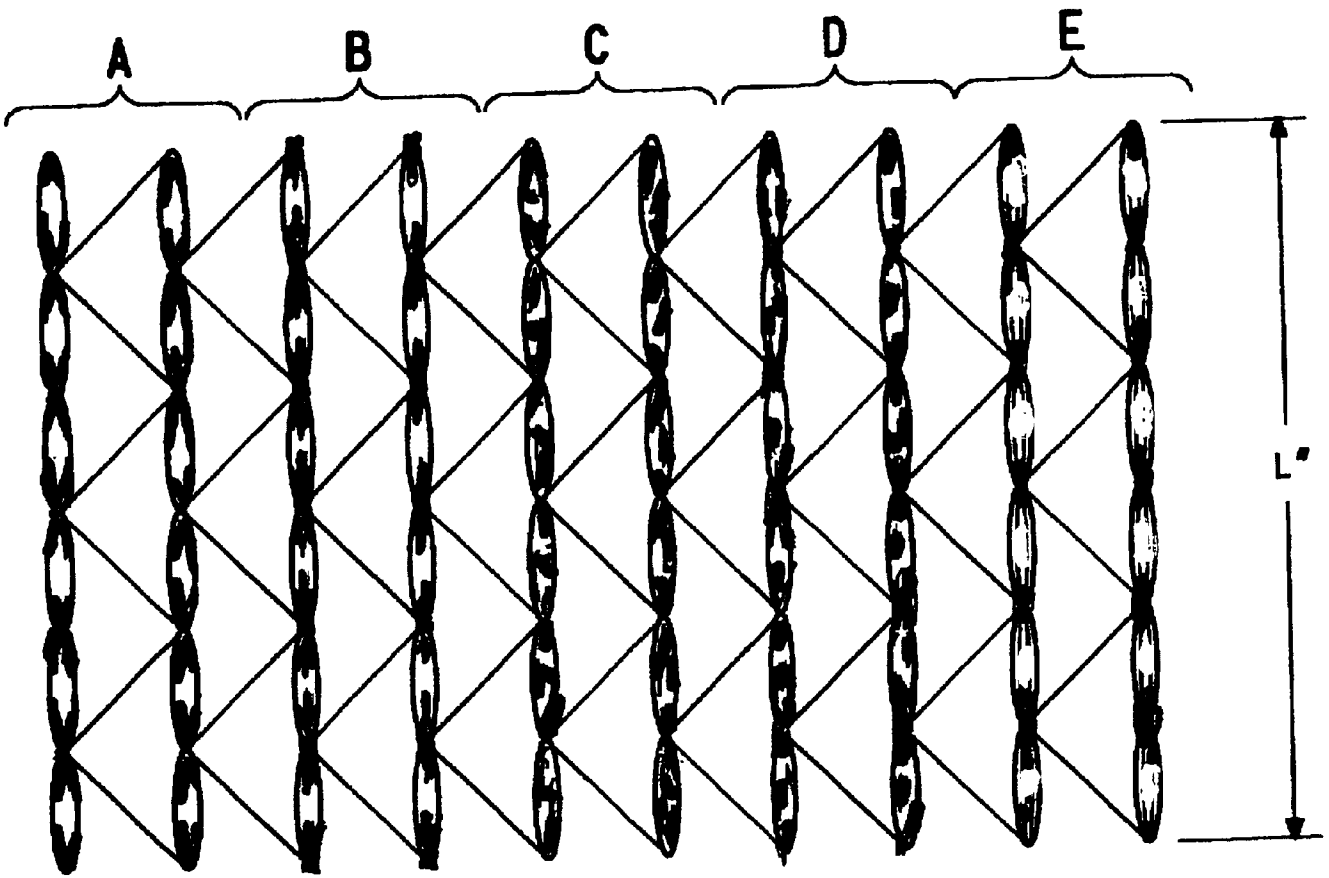

In the other branch of Implementation Path II the fabric 18 is subjected to the tensile force while being heated in the heating device 58. The surface speed relationship of the rollers 64, 66 is adjusted as discussed earlier to impose the tensile force on the fabric within the heating device 58. As a result, the fabric 18" emanating from the heating device 58 has a dimension D" that is greater than the dimension D of the fabric 18. In this instance the fabric 18" has a discontinuous linear array of beads 68 extending along the wales of the fabric is produced (FIG. 2F). The fabric 18", when slit by the slitting device 50, produces the finished chenille yarns 14.

It should be noted that in the instances where the binder is introduced in the form of the weft-extending strand 30W or in the form of the binder sheet 30P, shrinkage occurs both longitudinally and transversely. Thus, in the instance where heating is performed before slitting (i.e., Implementation Path II) it may also be necessary to constrain the fabric in the transverse direction during heating by the use of tenter hooks or clamps.

-o-0-o-

Enlarged detailed views of the structure of a knit fabric 18 produced by the knitting apparatus 16 are shown in the various panels of FIGS. 3 and 4. FIG. 3 depicts various constructions in which the underlaps are laid-into the structure while FIG. 4 shows corresponding constructions in which the underlaps are stitched-into the structure FIG. 3A illustrates the basic structure of a knit fabric having laid-in underlaps. The stitches 20 are formed by longitudinal chain stitches, such that the overlaps 22 of any given stitch 20 in any wale 24 are connected, chain fashion, to the longitudinally adjacent stitches by a central underlap 23. The yarns used to form the stitches 20 may be any hard, unstretchable, elastic, elastomeric or thermally shrinkable yarn. The underlaps 26 are defined by separate yarns that are laid-into the stitches 20 as the overlaps 22 are formed. Separate yarn beams, e.g., the beams 34 and 36, are required to form the overlaps 22/central underlap 23 and the laid-in underlaps 26, respectively, of the structure shown in FIG. 3A. The underlaps 26 should be formed from a hard or textured yarn. As suggested by the stipled shading, the binder 30 may be introduced along the wales 24 as a component 30C of the yarn forming the chain stitches.

Figure 4A:
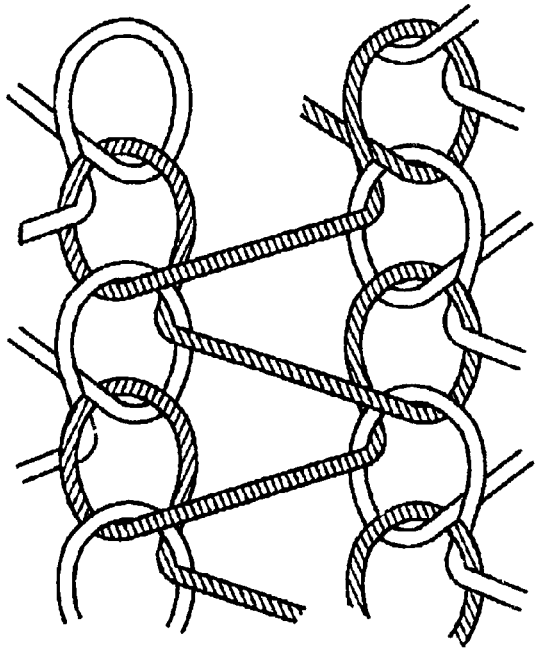
FIGS. 4A through 4E are enlarged views of the structure of a knit fabric having stitched-in underlaps produced in accordance with the present invention and having binder material introduced along the wales as discussed in connection with FIGS. 2A through 2E, respectively.

FIG. 4A illustrates the basic structure of a knit fabric having stitched-in underlaps. In this case alternate longitudinal overlaps 22 of the stitches 20 in a given wale 24 are formed. Underlaps 26 are the same yarn. Again, the binder 30 may be introduced along the wales 24 as a component 30C of the yarn forming the stitches.

Figure 3A:
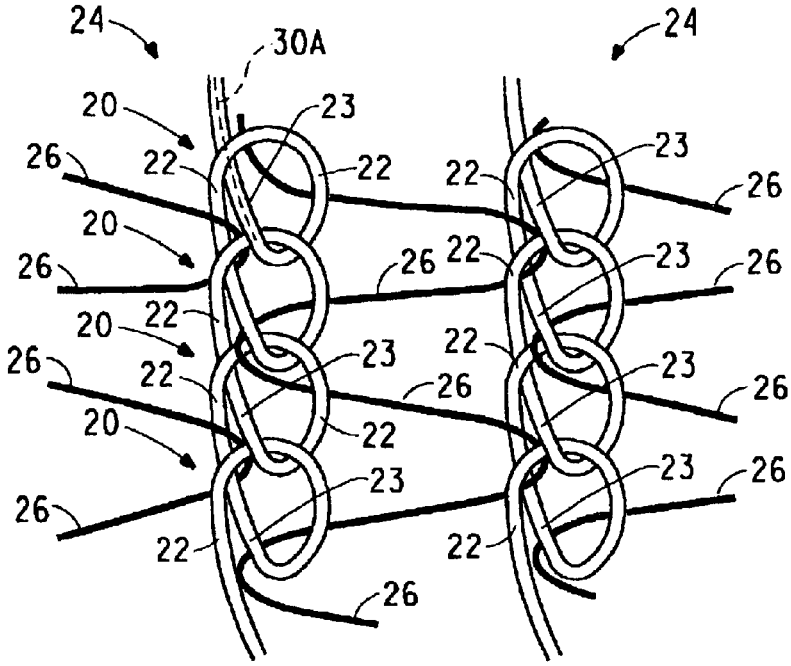
FIGS. 3A through 3E are enlarged views of the structure of a knit fabric having laid-in underlaps produced in accordance with the present invention and having binder material introduced along the wales as discussed in connection with FIGS. 2A through 2E, respectively.
Figure 3B:
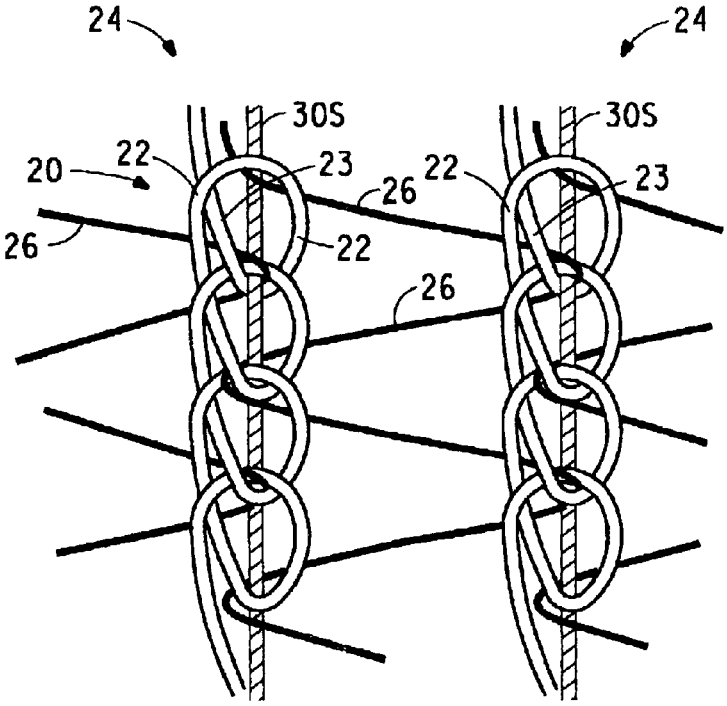
Figure 4B:
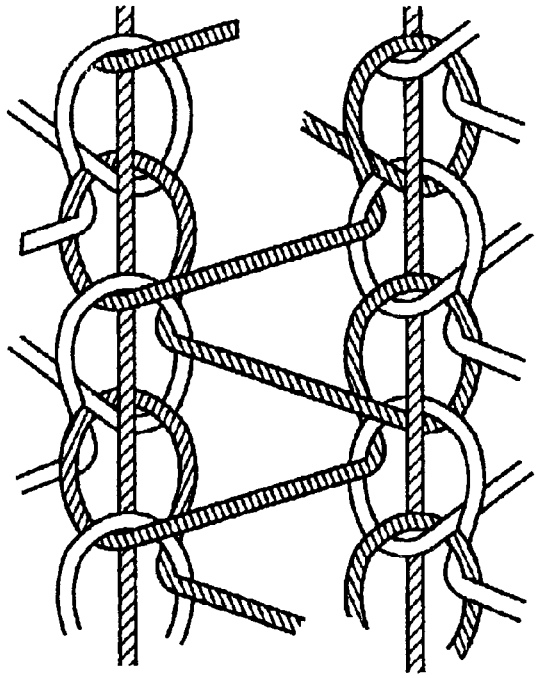

FIGS. 3B and 4B respectively illustrate the basic laid-in underlap structure and stitched-in underlap structure of FIGS. 3A, 4A in which a separate strand 30S of binder material extends longitudinally through the stitches of each wale. A yarn beam additional to the beams required to form the basic stitch structure is required to carry the longitudinal binder strand. Preferably, in such a case the binder is laid-in with a 0-0/1-1 or 1-0/1-0 configuration (claim 14).

Figure 3C:
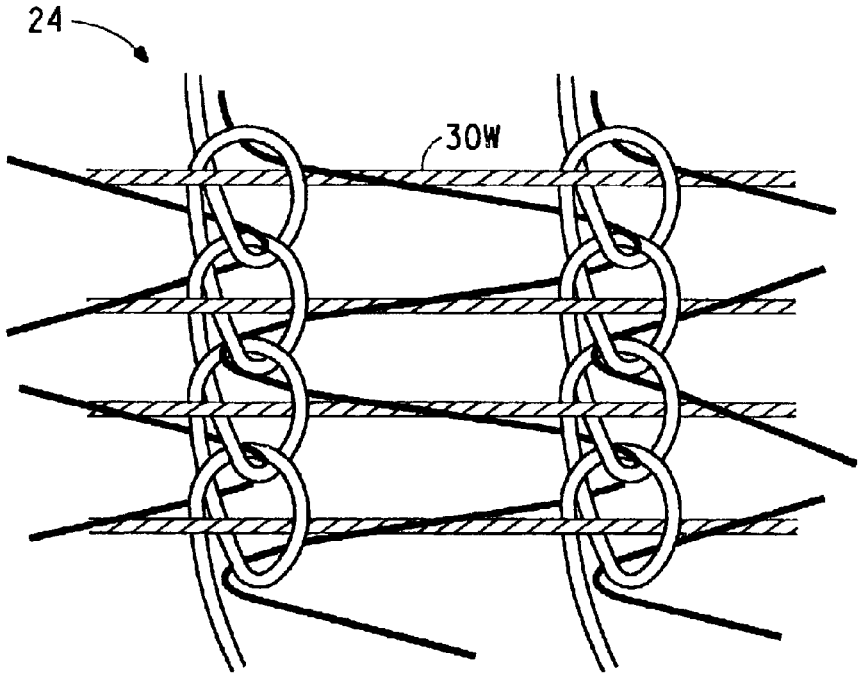
Figure 4C:
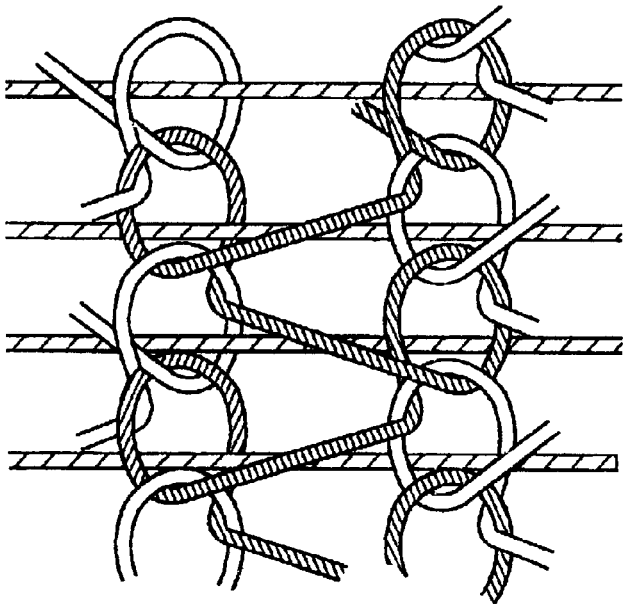

FIGS. 3C and 4C illustrate the respective basic laid-in and stitched-in structures of FIGS. 3A, 4A having the binder material in the form of the weft-extending strand 30W. The strand 30W is introduced into the basic structure by the weft insertion mechanism 46.

Figure 3D:
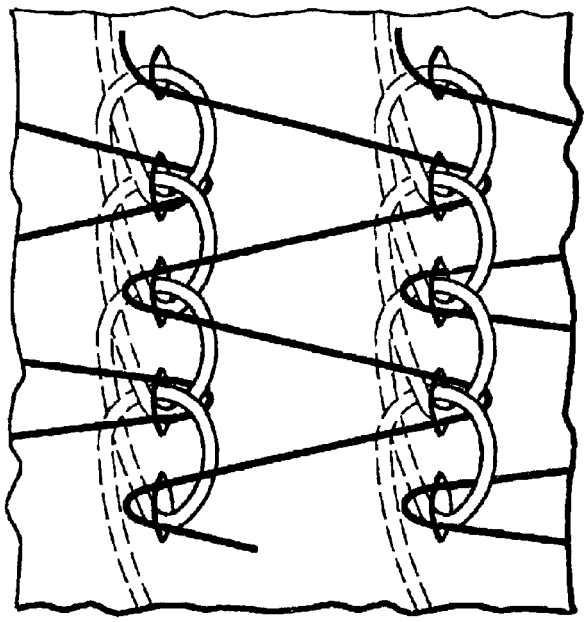
Figure 4D:
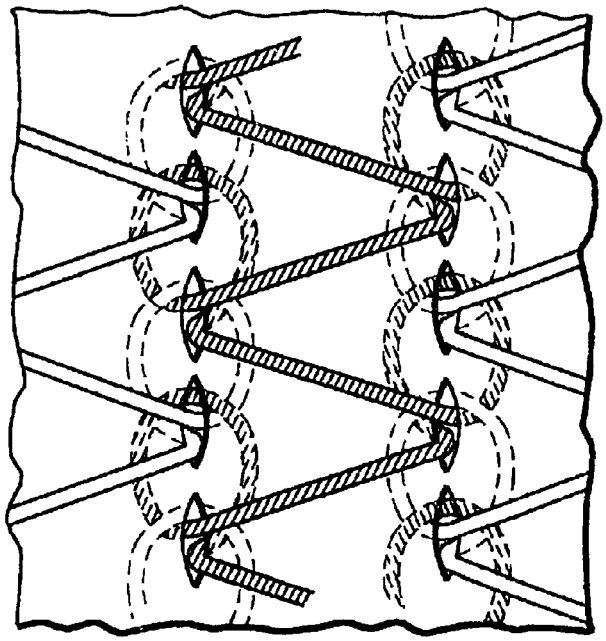

In FIGS. 3D and 4D the binder material takes the form of the sheet 30P into which the respective basic laid-in underlap structure and stitched-in underlap structures of FIGS. 3A, 4A are stitched. The sheet 30P of binder material is supplied on the roll 44.

Figure 3E:
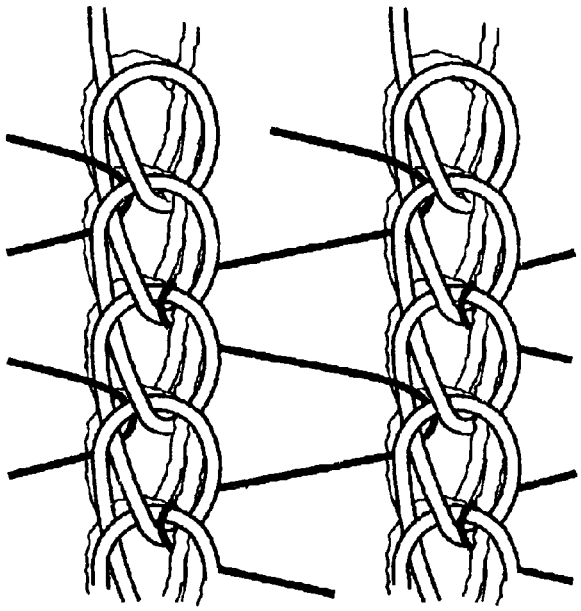
Figure 4E:
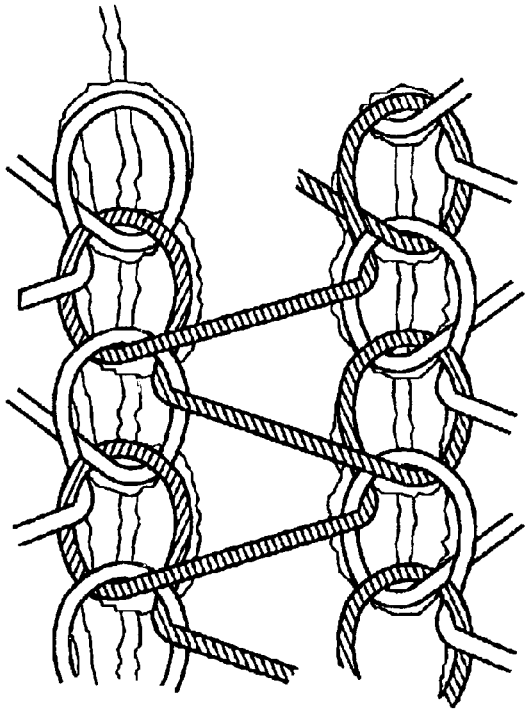

In FIGS. 3E, 4E the binder 30 may take the form of a yarn that is co-knit as a separate chain stitch with the basic stitch structures of FIGS. 3A, 4A forming the core.

A portion of a finished chenille yarn 14 formed from a knit fabric using a laid-in underlap structure is shown in FIG. 5A, while a finished chenille yarn formed from a knit fabric using a stitched-in underlap structure is shown in FIG. 5B. In either case the core 14C of the finished chenille yarn is defined by the overlaps 22 of the stitches 20 and the pile 14P of the finished chenille yarn is defined by the slit transverse underlaps 26. The pile elements 14P are held to the core 14C by one or more bead(s) 62 of activated binder material.

As may be appreciated from the foregoing it is seen that the present invention defines a low cost process for forming chenille yarn that is both very durable, and at the same time, soft, flexible and, preferably, stretchable. Multiple color capability, multiple fiber capability in pile and long pile is also available by choosing a variety of yarns forming laid-in or stitched-in underlaps originating from various beams shown in FIG. 1, as well as the use of pile forming fingers 16F.

Those skilled in the art, having the benefit of the teachings of the present invention as hereinbefore set forth may appreciate that various modifications may be made thereto. Such modifications are to be construed as lying within the contemplation of the present invention, as defined by the appended claims.

What is claimed is:

1. A method of producing a finished chenille yarn comprising the steps of:

a) knitting a warp knit fabric having a plurality of stitches formed by overlaps arranged in adjacent, longitudinally extending wales with transverse underlaps connecting the overlaps of adjacent wales, a binder material extending along the wales, b) slitting the fabric between adjacent wales thereby to define a plurality of precursor chenille yarns, each precursor chenille yarn including a wale of stitch overlaps and binder surrounded by an array of slit transverse underlaps;

c) either before or after slitting, respectively heating the fabric or the precursor chenille yarns to activate the binder; and d) either during or after heating, imposing a tensile force on the fabric or the precursor chenille yarns either to form a discontinuous chain of beads of binder within the core or to break the binder within the core into a discontinuous chain of beads of binder, respectively, whereby a finished chenille yarn is formed in which the core of the finished chenille yarn is defined by the overlaps of the stitches and the pile of the finished chenille yarn is defined by the slit transverse underlaps, the pile of the finished chenille yarn being held to the core by one or more bead(s) of binder.

2. The method of claim 1 wherein the heating of the fabric to activate the binder is performed before the slitting step.

3. The method of claim 1 wherein the heating of the chenille yarns to activate the binder is performed after the slitting step.

4. The method of claim 1 wherein the stitches of the warp knit fabric further include longitudinal underlaps, and wherein the core of the chenille yarn includes the longitudinal underlaps.

5. The method of claim 4 wherein the knit fabric includes chain stitches and laid-in stitches, the chain stitches having the overlaps and the longitudinal underlaps, and the laid-in stitches having the transverse underlaps.

6. The method of claim 1 wherein the binder takes the form of a yarn that is laid-into the overlaps of the stitches of the knit fabric.

7. The method of claim 1 wherein the binder takes the form of a yarn that is co-knit as a separate chain stitch with the knit stitches.

8. The method of claim 1 wherein the knit stitches are made from a composite yarn that includes a binder material.

9. The method of claim 1 wherein the binder takes the form of a yarn that is weft-inserted into the knit stitches.

10. The method of claim 1 wherein the binder is in the form of a sheet and the stitches of the knit fabric are formed through the sheet of binder material, and wherein the sheet is slit simultaneously with the slitting of the underlaps.

11. The method of claim 1 wherein the transverse underlaps are formed over an elevated finger.

12. The method of claim 11 wherein the binder is in the form of a sheet and the stitches of the knit fabric are formed through the sheet of binder material and wherein the sheet is slit simultaneously with the slitting of the underlaps.

13. The method of claim 1 wherein the warp knit fabric further includes weft-inserted yarns connecting the overlaps of adjacent wales.

14. The method of claim 1 wherein at least some of the stitches of the knit fabric are knitted-in stitches having the transverse underlaps which connect adjacent wales.

15. The method of claim 14 wherein the knitted-in stitches are made from a textured yarn.

16. The method of claim 14 wherein the transverse underlaps of the knitted-in stitches are formed over an elevated finger.

17. The method of claim 14 wherein the binder is in the form of a sheet and the knitted-in stitches of the knit fabric are formed through the sheet of binder material and wherein the sheet is slit simultaneously with the slitting of the underlaps.

18. The method of claim 1 wherein the tensile force is imposed after heating.

19. A chenille yarn comprising a longitudinally extending core with a plurality of pile extending therefrom, the pile being held by a binder material to the core, wherein the longitudinally extending core is formed as a knit stitch.

* * * * *